United States Patent [19]

Clements et al.

[11] Patent Number: 4,740,816

[45] Date of Patent: Apr. 26, 1988

[54] MEANS FOR DEVELOPING ELECTROPHOTOGRAPHIC IMAGES

[75] Inventors: Alwin S. Clements, Largs Bay; Peter Jauncey, Trinity Gardens; Brian J. Horrocks, Salisbury North; Alan J. Brock, North Adelaide, all of Australia

[73] Assignee: Cameronics Technology Corp. Ltd., Bayswater, Australia

[21] Appl. No.: 905,383

[22] PCT Filed: Dec. 12, 1985

[86] PCT No.: PCT/AU85/00314

§ 371 Date: Aug. 13, 1986

§ 102(e) Date: Aug. 13, 1986

[87] PCT Pub. No.: WO86/03603

PCT Pub. Date: Jun. 19, 1986

[30] Foreign Application Priority Data

Dec. 13, 1984 [AU] Australia ..... PG8544

[51] Int. Cl.[4] ..... G03G 15/10; G03G 15/01

[52] U.S. Cl. ..... 355/10; 355/4; 118/645; 118/659

[58] Field of Search ..... 355/10, 4, 77, 3 CH; 430/42, 117–119; 118/645, 659, 660, 662, 629, 630

[56] References Cited

U.S. PATENT DOCUMENTS

| | | | |
|---|---|---|---|
| 3,411,846 | 11/1968 | Naroff | 355/30 H |
| 3,456,109 | 7/1969 | Gawron | 355/30 H |
| 3,682,542 | 8/1972 | Mackenzie | 355/10 |
| 3,729,255 | 4/1973 | Reick et al. | 355/10 |
| 3,753,393 | 8/1973 | Niesen et al. | 355/10 X |
| 3,862,691 | 1/1975 | Fukushima et al. | 355/10 X |
| 3,944,355 | 3/1976 | Matkan | 355/30 H |
| 3,990,793 | 11/1976 | Anzai et al. | 355/10 |
| 4,014,608 | 3/1977 | Terashima | 355/4 |
| 4,073,266 | 2/1978 | Arneth | 355/10 X |
| 4,537,496 | 8/1985 | Ohba et al. | 355/10 |

FOREIGN PATENT DOCUMENTS

| | | |
|---|---|---|
| 9389 | 2/1968 | Australia . |
| 18537 | 9/1968 | Australia . |
| 15177 | 11/1971 | Australia . |
| 39680 | 9/1973 | Australia . |
| 30234 | 12/1973 | Australia . |
| 408652 | 2/1974 | Australia . |
| 430772 | 3/1974 | Australia . |
| 418503 | 3/1974 | Australia . |
| 459381 | 4/1974 | Australia . |
| 516109 | 5/1974 | Australia . |
| 40292 | 4/1980 | Australia . |
| 1011212 | 11/1965 | United Kingdom . |
| 1333421 | 10/1973 | United Kingdom . |
| 1333422 | 10/1973 | United Kingdom . |

*Primary Examiner*—R. L. Moses

*Attorney, Agent, or Firm*—Cushman, Darby & Cushman

[57] ABSTRACT

Means for developing Xerographic images in which a developer applicator (21) is arranged to progressively apply a liquid developer to a latent electrostatic image on an image-bearing surface on a support member (3) and the surface is progressively pressed to a smooth conductive surface (19) to express excess developer liquid from the image-bearing surface to provide a relatively dry member containing the relatively dry developed image, a corona charging system (7) is included and also means (40-41-42) for multistage developement of color images.

7 Claims, 2 Drawing Sheets

MEANS FOR DEVELOPING ELECTROPHOTOGRAPHIC IMAGES

SUBJECT OF INVENTION

Figure 1:
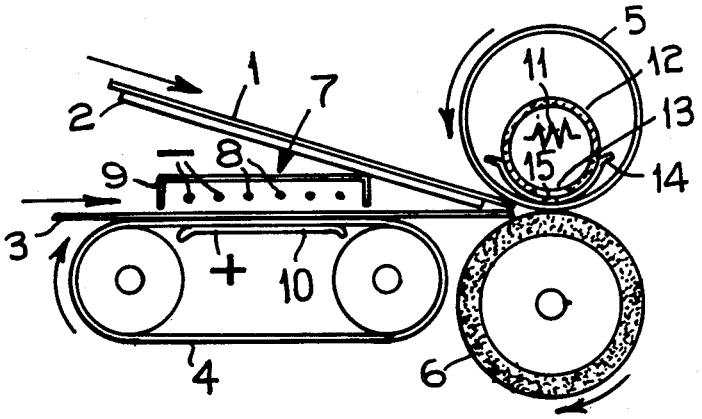

This invention relates to a method of and means for developing electro-photographic images and in particular it relates to a machine of the type in which a photoconductive surface is charged, exposed to an image, and then developed by a system of liquid development.

PRIOR ART

It is customary in electro-photography to have a surface on which is a layer of a photo-sensitive material which is energized by first charging the surface and then exposing the surface to produce an image and to then develop the image with particles which are attracted to the surface according to the charge pattern.

The particles which are attracted to the latent electro-static image can be suspended in air or applied with a magnetic brush to form the final image by fixing to the paper and constitutes what is referred to as the dry system of development, or they can be suspended in an insulating liquid, such particles being controlled with fixing agents so that on drying the image is fixed, this being referred to generally as the liquid system which this invention uses.

The problem associated with the liquid system of development as exemplified in the office copying machines are mainly due to the fact that the electro-photographic papers is immersed entirely in the hydro-carbon insulating liquid in which the developer particles are suspended, thus requiring considerable energy to dry the copy after development.

OBJECTS OF THE INVENTION

One of the objects of the present invention is to overcome this problem, this being achieved by developing latent electro-static images using liquid toners applied only to the electro-photographic surface on which the latent electro-static image resides. To achieve this the electro-photographic paper is subjected on one side to the developer and is then passed between pressure means, such as a pair of rollers, one of the rollers being formed by smooth conductive material such as polished metal while the other roller, which is urged against the first roller, is coated with a non-solvent aborbent but resilient material so as to squeeze the excess liquid developer from the surface of the sheet.

The progressive pressure means act not only to remove the excess hydro-carbon liquid required for development but also applies a bias to bring about "fill in" of the solid areas of the latent electro-static image.

Another problem associated with liquid office copying machines arises from the fact that the paper base on which the electrophotographic sensitising layer is coated is treated, sometime prior to coating with the electro-photographic material with a conductive substrate, and this conductive substrate material "bleeds up" into the electrophotographic layer so that on close examination of the image developed by a liquid developer system, myriads of white spots are revealed throughout the coating which degrades the image and thus destroys the resolving power of the photoconductor. Another object is to avoid this problem, and this is achieved according to this invention by using a paper which is not provided with such a conductive layer, such a paper having been disclosed in U.S. Pat. No. 4,134,762. When this paper is used with this development and charging system the defects in the final image of prior art systems are eliminated.

A preferred embodiment of the principle established above of using a metal roller acting as a bias and which is urged against a resilient non-solvent absorbent covered roller so as to squeeze the excess liquid developer from the surface of the sheet of electrophotographic paper can be constructed in a machine so that the charging means, the exposure means and the development means are all situated in the same plane thus eliminating the problem of turning the exposed electrophotographic membrane through 180° to bring to the development rollers.

By using a system of small individual belts suitable for handling a large drawing or transparency the electrophotographic paper can be fed into the machine by various means either as individual sheets or from a continuous roll, lengths of which can be guillotined to assist whatever length is desired, receive a charge from a corona source and pass under an exposure system referred to previously and then pass through the developer station to emerge as an electrographic print in any desired colour.

A method of developing Xerographic images according to this invention consisting in developing the latent electrostatic image on the Xerographic paper by submitting the paper to a developer applicator applied only to the surface containing the latent electrostatic image, and progressively pressing the surface containing the wetted developer image against a smooth conductive surface by means of a resilient member whereby to intensify development of the said image on the said surface and express liquid developer from the paper whereby to produce a relatively dry paper containing the relatively dry developed image.

The means to express liquid developer from the surface may consist in passing the paper between a smooth conductive roller and a resilient roller with the surface containing the developer in contact with the said conductive roller. The preferred paper comprises a relatively nonconductive surface having bonded to it a photoconductive surface without an intermediate conductive substrate.

The basis of this invention and a machine layout in general is diagramatically illustrated in the drawing forming part hereof but the illustrations are not necessarily to be taken as limiting the invention to the specific arrangement shown, the invention being defined in the claims herein.

Figure 2:
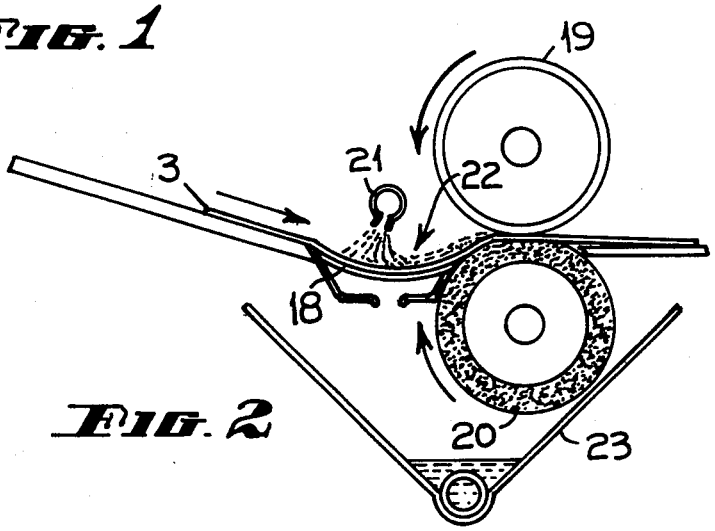
Figure 3:
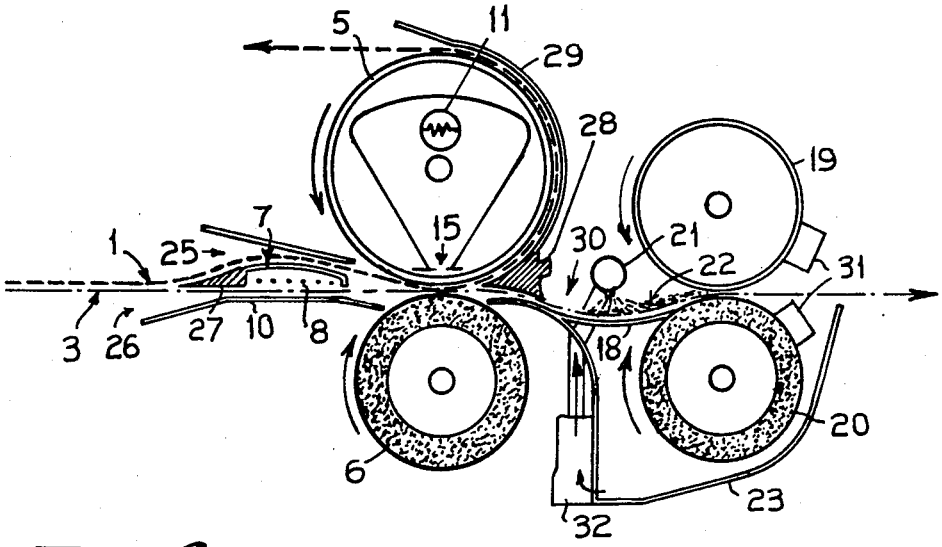
Figure 4:
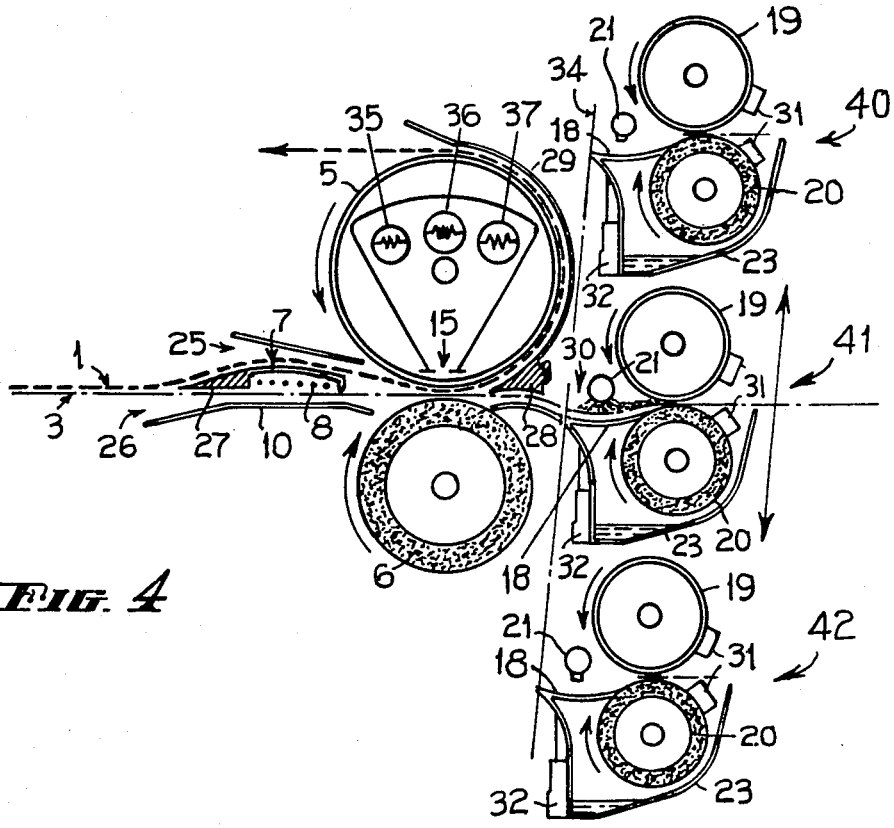

In the drawings:

FIG. 1 is a diagramatic end view of one form of the charging assembly of this invention, FIG. 2 is a diagramatic end view of the developer section of this invention, FIG. 3 is a schematic view of a machine according to this invention as used for monochroic development, and FIG. 4 is a view similar to FIG. 3 allowing the machine arranged for colour development.

Referring first to FIGS. 1 and 2 the transparency 1 is fed into the machine from a table 2 while the sheet of Xerographic paper 3 is fed into the machine by an endless belt 4. The table 2 and belt 4 are positioned to direct the transparency 1 and the Xerographic sheet 3 into the nip of a pair of rollers 5 and 6.

The roller 5 is transparent and is synchronously driven with the roller 6 which is a resilient pressure roller.

The Xerographic paper 3 is charged while on a conveyor 4 in the form of a belt by a charging assembly 7 comprising an array of electrical high tension wires 8 in a hood 9, and on the other side of the belt 4 beneath the corona assembly 7 is an electrode 10.

High tension is applied from any suitable source to the array of wires 8 and the electrode 10 and the supply is preferably such that the wires 8 are negatively charged with the electrode at a positive potential.

Exposure is effected between the rollers 5 and 6. The light transparent roller 5 has a light source 11 in it which is disposed in a tube 12 having a relatively large slit 13 in it but a cylindrical iris diaphragm 14 has a variable longitudinal aperture 15 which by its selected dimension controls the exposure.

The resilient roller 6 presses the transparency 1 and the Xerographic paper 3 together at the contact nip of the rollers 5 and 6 to effect the exposure.

The rollers 5 and 6 which can be termed the "exposure rollers" discharge the transparency 1 and the Xerographic sheet 3 which now has an electrostatic image on it and the transparency is removed from the Xerographic paper 3.

The Xerographic paper 3 is developed by feeding it on to guides 18 which may comprise a series of downwardly concaved spaced rods running in the direction of the paper feed over the concave surfaces of which it is moved forward into the nip of a pair of rollers 19 and 20, the roller 19 being a smooth conductive roller, such as a polished metal roller, and the roller 20 being a resilient pressure roller. These rollers are termed the "developer rollers" and are preferably driven at slightly different peripheral speeds so that they have a squeegee action.

Situated above the guides 18 are transverse spray nozzles 21 which directs developer downwards to the guide 18, but this spray is timed to discharge the developer only when a sheet of Xerographic paper 3 is moving over the guides 18 and between the nip of the developer rollers 19–20. Because of the concave shape of the sheet 3 as it rests on the guides 18 a transverse trough 22 is formed by the sheet 3 and the developer deposits into this trough and spreads laterally so that excess flows over the ends of the trough so formed into a tank 23 from which the developer can be recirculated. By the arrangement described, the Xerographic sheet 3 is wetted on the upper surface only, and the underside of the sheet remains dry.

Development is completed when the resilient roller 20 presses the surface of the Xerographic sheet 3, which is wetted by the developer, on to the polished metal surface of the roller 19, which action also forces any liquid developer back toward the trough 23 and in this way the image on the Xerographic sheet 3 is developed and the sheet 3 leaves the developer rollers 19–20 in a dry state.

According to the form of the invention shown in FIG. 3, in which corresponding parts have similar numerals, the transparency 1 and the Xerographic paper 3 are held together and have their leading edges fed into a pair of channels 25 and 26 disposed one on each side of a separator 27 which forms part of the charging array 7 where the electrophotographic paper is charged between the wires 8 of the array and the electrode 10 above which the paper passes. As the transparency 1 and the Xerographic paper 3 are pushed forward they are pushed towards each other to pass between the pair of exposure rollers 5 and 6, one of which is again a transparent roller and the other a resilient roller, the transparent roller 5 having in the light source 11 operating through a slit 15 to expose the Xerographic paper to the slit as the two rollers 5 and 6 are driven with synchronized peripheral surface speeds to have a squeegee action.

Immediately the exposure is effected the transparency 1 is separated from the electrographic paper 3 by the paper separator 28 and is guided back out of the machine by a guide 29 extending part way around the transparent roller 5 and the now exposed electrophotographic paper 3 is moved through the developer area 30 where the developer is sprayed from the spray nozzle 21 onto the sensitised surface of the electrophotographic paper 3 and forms a pool in the trough 22 which empties over the edges back into the tank 23 so that the back of the paper is not wetted by the developer and the paper with the developed image thereon then passes between the developer rollers 19 and 20, and one of which as in the earlier described form is a metal roller 19 and the other of which is a roller 20 with a resilient surface which is not affected by the developer so that any remaining developer is squeezed out and flows back into the tank 23 and a dry print issues from the machine. Wipers 31 are positioned against the developer rollers 19–20 to ensure that their surfaces are kept clean. A pump 23 which circulates the developer is shown.

In the form shown in FIG. 4 the colour developer mechanisms are moved in the plane of the chain line 34 in conformity with the colour of the exposure light being used.

For three colour printing three colour lamps 35, 36 and 37 are used and three colour developer sections can be used which can be selectively activated in the machine to match a selected colour exposure.

In FIG. 4 three colour sections are shown, the first section 40 having a developer of a first colour, the second section 41 having a second colour and the third section 42 having a third colour. As the mechanism are similar to these described the constructional details will be readily understood without further description.

It will be realised because of the simple method of passing the electrophotographic paper together with the transparency through a light source after charging the image can first be developed in one colour and the photosensitive membrane containing the image can then be again associated with a transparency after being recharged and passed through the machine with the use of light of a different colour and a developer suitable to that colour and so on so that a large plan for instance could be over-printed in various colours to achieve required effects.

Such a machine does not have the complication usually found where three colour or four colour prints are attempted in a fully automatic machine bacause the handling of the print produced in association with a colour transparency from which reproduction is required by an operator greatly facilitates this handling, and an operator can simply recirculate the electrophotographic print and the transparency the required number of times to overprint according to requirements.

Thus a machine is envisaged in which a transparency and a photoconductive membrane without a conductive inbuilt layer are passed around an exposure roller and the transparency is then separated from the photoconductive membrane with the membrane being passed on to the developer section where it is subjected to the developer on one side only and excess developer squeezed from it with development taking place between a conductive roller and a resilient roller to achieve the effects outlined earlier herein, and each print so produced can be recycled through the machine using a different colour exposure light and developer as required.

Obviously instead of using lights of different colour the transparent drum surrounding the light could simply have a slit as the exposure means as exposure required for electrophotographic paper is relatively short and either the speed of movement of the paper or the size of the slit could be varied and the slit could have colour filters associated with it where colour copying is undertaken.

In this specification the term "Xerographic Paper" includes a membrane of any suitable material having on at least one face a coating of a Xerographic material such as a photoconductive Zinc Oxide.

While in the illustrations the exposing of the photoconductive surface is shown as being effected by means of a positive or a negative, the invention is not limited to this as the developer section can equally be used on Xerographic membranes which are exposed by for instance mono or colour projection or reflexing.

The claims defining the invention are as follows:

1. Means for developing latent Xerographic images on the photoconductive surface of Xerographic paper comprising a corona to charge the photoconductive surface means to image-wise expose the said photoconductive surface to produce a latent electrostatic image, means to apply a liquid developer to the said surface to develop the latent electrostatic image and means to develop the latent electrostatic image wherein;

(a) the corona to charge the photoconductive surface of the paper (3) comprises a conveyor (4) adapted to be driven to move the said Xerographic paper (3) through a charging zone comprising an array of charging wires (8) spaced from the said conveyor on one side thereof, the hood (7) over the said array of wires, and an electrode (10) on the other side of the conveyor (4), (b) the exposure means comprise a pair of interengaged rollers (5–6) adapted to be oppositely driven one roller (5) being transmitting and enclosing a light source (11) and containing a longitudinal aperture (15), the other having a resilient face engaging the light transmitting roller (5) at the said aperture (15), said conveyor (4) being positioned to feed the charged paper (3) into the nip of the said rollers (5–6), and (c) the developer applicator comprises means (21) arranged to progressively apply a liquid developer to the side only of the paper which contains the said latent electrostatic image on the said Xerographic paper (3), and (d) the means to develop the latent electrostatic image comprise a second pair of rollers (19–20) and adapted to be oppositely driven to receive the said charged Xerographic sheet (3) after it has passed over guide means (18) disposed between the said rollers (5–6 and 19–20) also arranged to form a trough (22) in the paper between the rollers into which the said applicator (21) feeds developer, said roller (19) having a smooth conductive surface, said roller (20) having a resilient surface to press the said Xerographic paper onto the said smooth conductive surface to express excess liquid developer from the said Xerographic paper back into the said trough (22).

2. Means for developing latent Xerographic images according to claim 1 characterised in that the said Xerographic paper 3 is moved through a liquid developer station (19-20-21), guide means (18) in the said developer station to form a downwardly formed trough (22) in the paper (3) which extends transverse to the direction of movement of the paper and has open sides, said developer applicator (21) being positioned to deposite developer into the said trough (22) to flow out over the sides thereof, said smooth conductive surface being formed on a roller (19) having its axis transverse to the movement of the paper and positioned on the edge of the said trough (22), the said means to progressively press the said image bearing surface against the said smooth conductive surface comprising a roller (19) having a resilient surface, said rollers (19–20) being positioned to express liquid developer back into the said trough (22) as the said paper (3) moves forward between the said rollers (19–20).

3. Means for developing Xerographic images according to claim 1 wherein the means to charge the photoconductive surface of the Xerographic paper (3) comprises an array of high electrical tension wires (8) in a hood (9) positioned over conveyor means (4) for the Xerographic paper, and an electrode (10) beneath said conveyor means (4), said array of high electrical tension wires (8) having a negative potential and said electrode (10) having a positive potential.

4. Means for developing Xerographic latent images according to claim 1 wherein the said hood (7) has a paper separator (27) at a forward end to separate a transparency (1) and a Xerographic paper (3) whereby the said transparency (1) is guided over the said hood (7) and the said Xerographic paper is guided to beneath the said hood to feed the said transparency (1) on to the charged Xerographic paper (3) at the nip of the rollers (5–6) to be drawn forward by the said rollers to effect an exposure of the charged photoconductive surface of the Xerographic paper (3) to the said tranparency (1), and by a paper separator (28) between the said rollers (5–6) and the said guide means (18) to separate the said transparency (1) from the said Xerographic paper (3) and guide the said Xerographic paper (3) on to the said guides for development.

5. Means for developing Xerographic images according to claim 1 or 4 wherein the said trough (22) has open ends to allow excess developer liquid to flow back to a tank (23) disposed below the said trough (22).

6. Means for developing xerographic images according to claim 1 wherein said trough has open ends to allow excess developer liquid to flow back to a tank disposed below said trough.

7. Means for developing xerographic images as in any one of claims 1, 4, 5 and 6 wherein said developer rollers are driven to have slightly different peripheral speeds whereby to effect a squeeze action on said xerographic paper.

* * * * *